US005626226A

United States Patent [19]

Gardiner et al.

[11] Patent Number: 5,626,226

[45] Date of Patent: May 6, 1997

[54] TAMPER-RESISTANT, POINT-OF-SALE, ARTICLE DISPLAY PACKAGE

[75] Inventors: Walter A. Gardiner, Waccabuc; David A. Swinden, Ellenville, both of N.Y.; Joseph A. Hufnagel, Bethel, Conn.

[73] Assignee: Imperial Schrade Corp., Ellenville, N.Y.

[21] Appl. No.: 512,802

[22] Filed: Aug. 9, 1995

[51] Int. Cl.[6] ..... A45C 11/26

[52] U.S. Cl. ..... 206/349; 206/461; 206/477; 206/756

[58] Field of Search ..... 206/349, 461, 206/470, 477, 481, 488, 756

[56] References Cited

U.S. PATENT DOCUMENTS

| | | | |
|---|---|---|---|
| 618,410 | 1/1899 | Goldsmith | 206/481 |
| 1,614,740 | 1/1927 | Lee | 206/349 |
| 4,749,082 | 6/1988 | Gardiner et al. | 206/349 |
| 5,064,056 | 11/1991 | Gresh | 206/470 |
| 5,090,568 | 2/1992 | Tse | 206/470 |
| 5,133,454 | 7/1992 | Hammer | 206/470 |

*Primary Examiner*—David T. Fidei
*Attorney, Agent, or Firm*—Kirschstein et al.

[57] ABSTRACT

A display package for an article includes a front and a rear panel having respective peripheral portions secured to one another in an operative condition of the package. At least the front panel is provided with a recess constituting, together with a juxtaposed portion of the rear panel, a compartment for accommodating the article therein with substantially no movement therein in the operative condition of the package. A holding element is also substantially immovably received in the compartment and extends across a corresponding portion of the article remotely from the rear panel to confine the article between itself and the rear panel. The holding element is substantially rigid, and each of the front panel and the holding element is of a transparent material.

5 Claims, 2 Drawing Sheets

FIG. 1
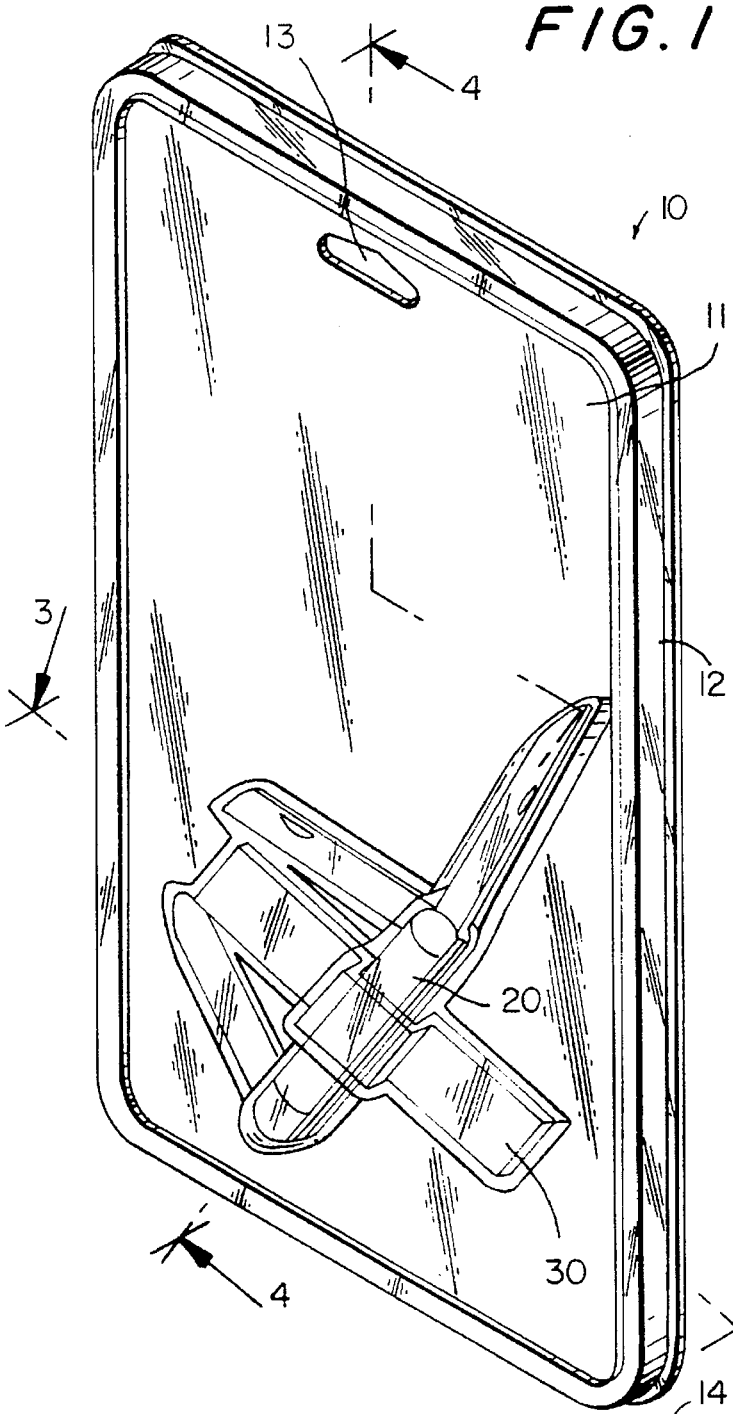
FIG. 2
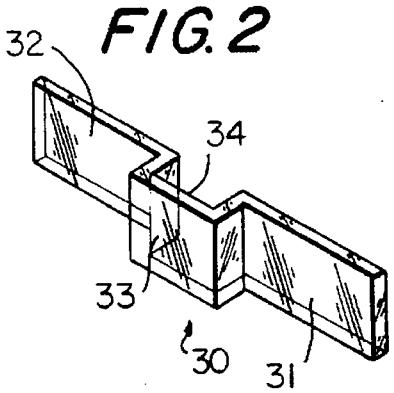
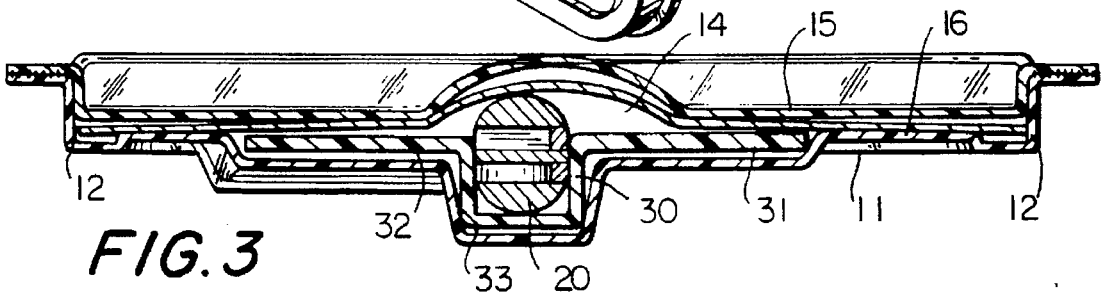
FIG. 3

FIG. 4
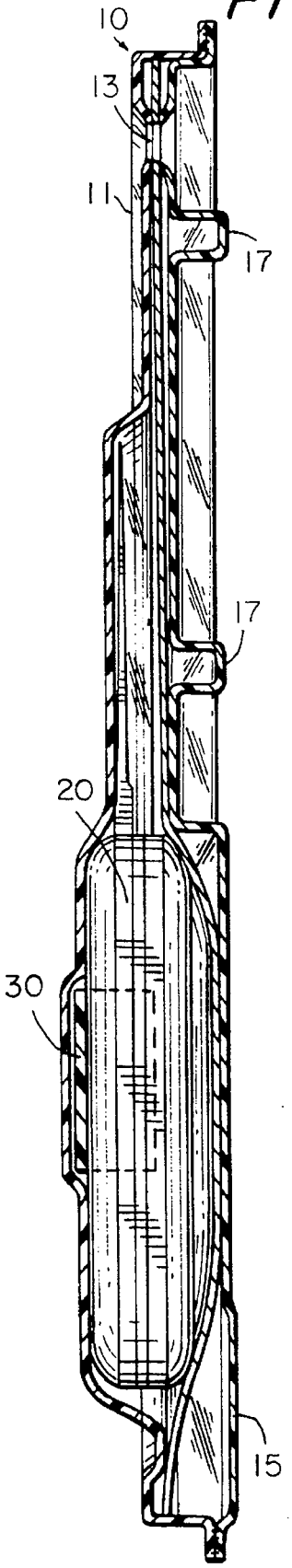
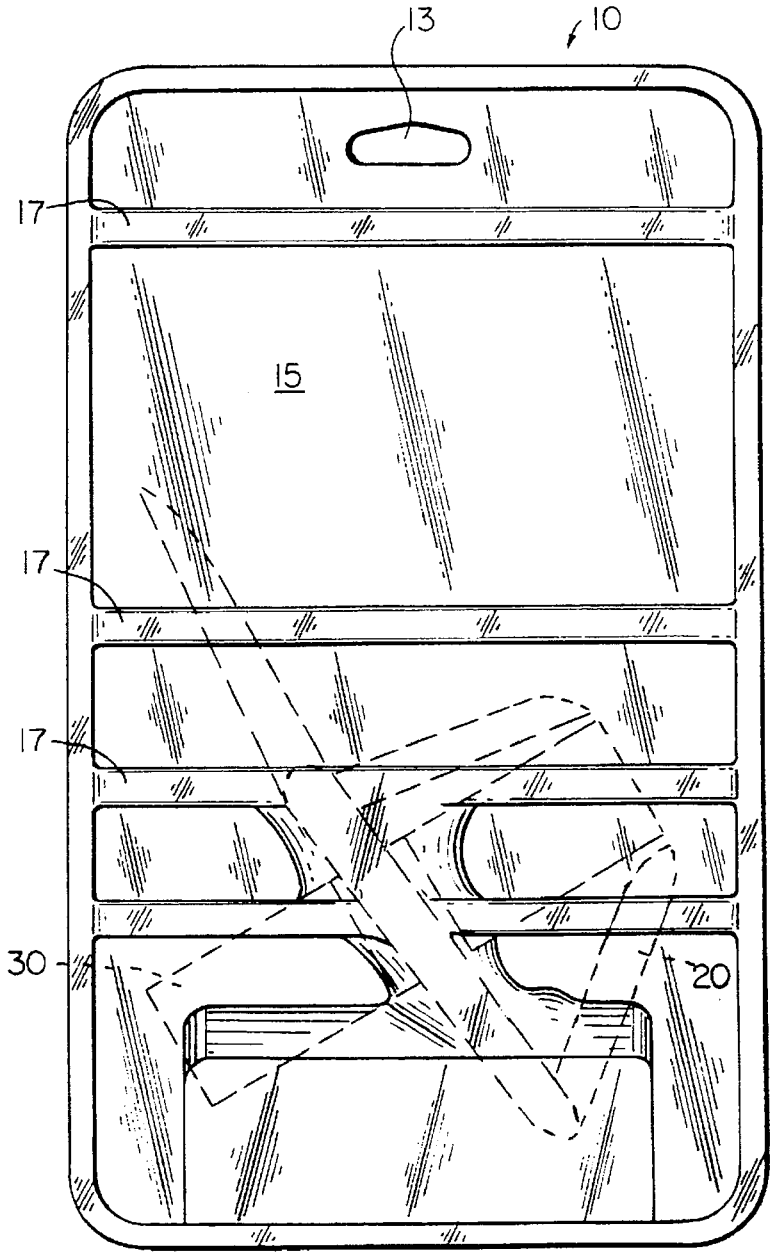
FIG. 5

TAMPER-RESISTANT, POINT-OF-SALE, ARTICLE DISPLAY PACKAGE

BACKGROUND OF THE INVENTION

1. Field of the Invention

The present invention relates to point-of-sale article packaging in general, and more particularly to packages for displaying articles on sale through their transparent front panels.

2. Description of the Related Art

There are already known various constructions of packages for a variety of articles to be sold, among them so-called blister packages that are referred to in this manner because of their resemblance to blisters. The basic idea behind these packages was to contain the articles in a manner that would allow the prospective purchaser to observe them or even visually examine them, without gaining direct access to them, though.

While the original idea may have been to display the articles to their best advantage, experience has shown that their use also reduces the degree of pilferage, whether intentional or unwitting, of especially small articles. This is especially true with the advent and relatively widespread use of store door alarm devices, since it is relatively easy to provide the package with a tag or similar element that would trigger the alarm unless deactivated by the cashier or store clerk, whereas it would be at least impractical to try to provide each article, no matter how small, with such a triggering element.

However, it has been established that the ingenuity of storekeepers is at least matched by that of shoplifters who came up with a method of avoiding detection of their illegal appropriation of such articles: merely remove the respective article from its package and secrete it on your person. The idea is that, unless this act is detected while in progress, the perpetrator will either walk out of the store without triggering the alarm or, if searched, the origin of the article will be difficult to prove, both as a result of having left the incriminating package behind. All it takes to remove the article from its blister package is a quick cut through the front panel, and a deft move to extract the article from the package through the thus created slit. Of course, the store owners were not happy about such developments, and expressed their feelings to the article manufacturers and/or packagers who found it impossible not to listen to and be concerned with such legitimate complaints.

OBJECTS OF THE INVENTION

Accordingly, it is a general object of the present invention to avoid the disadvantages of the prior art.

More particularly, it is an object of the present invention to provide a blister package for a variety of articles that does not possess the drawbacks of the known packages of this type.

Still another object of the present invention is to devise a blister package of the type here under consideration that makes it almost impossible for the article to be removed from its compartment in the blister package through a single slit, regardless of its direction.

It is yet another object of the present invention to design the above blister package in such a manner as to be virtually tamper-proof and yet relatively easy for its legitimate owner to open.

A concomitant object of the present invention is so to construct the blister package of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in a display package for an article, which package includes a front and a rear panel having respective peripheral portions secured to one another in an operative condition of the package. Means is provided on at least the front panel for delimiting a recess constituting, together with a juxtaposed portion of the rear panel, a compartment for accommodating the article therein with substantially no movement therein in the operative condition. In accordance with the present invention, a holding element is also substantially immovably received in the compartment mid extends across a corresponding portion of the article remotely from the rear panel to confine the article between itself and the rear panel.

A particular advantage of the present invention as described so far is that, because of the presence of the holding element in the package and the supplemental confining action it provided on top of that provided by the front panel itself, it is much more difficult than before to remove the article from its compartment. This is especially true when, in accordance with a currently preferred aspect of the present invention, the holding element is substantially rigid, inasmuch as then its holding action cannot be quickly and conveniently terminated by either cutting through it or bending it out of the way of removal of the article.

Advantageously, at least the front panel of the package is of a transparent material. Under these circumstances, it is especially advantageous for the holding element to be of a transparent material as well, so that it will not interfere with visual observation or examination of the article confined in the package.

According to another advantageous facet of the present invention, the holding element includes two end portions that are aligned with one another and are confined in the compartment between the front and rear panels, and an intermediate portion rigidly connected with the end portions and situated at a distance from the rear panel to bound a recess for receiving the corresponding portion of the article. It is also advantageous to further provide at least one reinforcing rib on at least one of the front and rear panels for impeding bending of the package in a manner that would facilitate removal of both the holding element and the article through a single slot cut into the front panel. The display package is especially suited for use in a situation in which the article is a pocket knife including a handle and at least one cutting blade fixed or foldable into the handle. In this case, the aforementioned corresponding portion of the article is a substantially centrally located section of the handle.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a front perspective view of a tamper-resistant article display package embodying the present invention;

FIG. 2 is a perspective view of an article holding insert of the present invention that is strategically positioned within the package of FIG. 1 relative to the displayed article in an assembled condition of the package;

FIG. 3 is a cross-sectional view taken through the article display package along line 3—3 of FIG. 1;

FIG. 4 is a sectional view through the article display package taken on line 4—4 of FIG. 1; and FIG. 5 is a rear view of the package of FIG. 1.

DETAILED DESCRIPTION OF THE PREFERRED EMBODIMENT

Referring now to the drawing in detail, and first to FIG. 1 thereof, it may be seen that the reference numeral 10 has been used therein to identify a display package of the present invention in its entirety. As illustrated, the package 10 is of the so-called blister package type, that is it includes at least a front panel 11 that is of a transparent material to permit unimpeded view of an article 20 that is to be on display in the retail establishment while contained in the package 10.

As shown, the front panel 11 is provided with a circumferentially extending rib 12 that reinforces the front panel 11. As well known per se, the package 10 includes at its upper region a centrally located through opening 13 by means of which the package 10 can be suspended from a hook or a similar support that projects in a finger-like manner from a display stand or rack arranged at an appropriate location of the retail establishment.

As a comparison of FIGS. 1 and 3 will reveal, at least the front panel 11 is contoured at its central region so as to provide a compartment 14 that receives the article 20 in a substantially snug fashion, that is, with only a minimum leeway, if any. As a matter of fact, in the illustrated implementation of the package 10 for accommodating the article 20 in the form of a pocket knife in its partially open condition, even a rear panel 15 and an intermediate or backing panel 16 that is accommodated between the front and rear panels 11 and 15 are formed with respective recesses or depressions that complement the contoured portion of the front panel 11 to form the aforementioned compartment 14.

The front and rear panels 11 and 15 are peripherally joined with one another in any well known manner, such as being glued or thermally welded to each other, the latter approach being currently preferred when the front and rear panels 11 and 15 are of the same or similar synthetic plastic material because it gives the highest degree of assurance that the package 10 cannot be easily opened by simply dissociating the panels 11 and 15 from one another along their peripheral edges. On the other hand, the intermediate panel 16, which may be of a material that is dissimilar from that or those of the front and rear panels 11 and 15, such as of paper or cardboard, and may contain aesthetically pleasing background for, and/or informative or advertising matter relating to the article 20, its manufacturer, other products of the same manufacturer, or the like, need not be physically connected with either one of the panels 11 and 15. Rather, it may just be dimensioned to fit without too much freedom of movement into the space delimited by the outer wall of the rib 12 of the front panel 11, mid be merely confined or sandwiched between the two panels 11 and 15.

As described so far, the article display package 10 of the present invention does not differ too much from traditional blister packages, if at all. However, experience with such traditional packages has shown that they are vulnerable to tampering by a person bent on stealing the article 20. More particularly, it has been established that such persons, rather than taking the entire package 10 and thus exposing themselves to the danger of being caught with the article 20 still in its packaged state, giving a clear indication if not proof that such article 20 has not been in their possession prior to entering the store, oftentimes quickly but artfully cut through the front panel 11 to provide a slit through which to access the compartment 14 and remove the article 20 from the package 10. This not only avoids triggering an exit alarm device in stores with sophisticated shoplifting alarm systems by the effect of tags or similar alarm-triggering elements that are typically provided on or embedded in the package 10 as the perpetrator walks out of the store, but renders it difficult if not impossible for the store owner, or store security or other personnel to disprove the perpetrator's typical assertion that he or she had had the article 20 for ages, or at least from a time prior to entering the store, unless the perpetrator is observed or, better yet, photographed or video-recorded in the act or removing the article 20 from the package 10.

The vulnerability of the package 10 to such attack is attributable to the fact that, for a variety of reasons, among them the cost and excessive transportation weight of the package, but also a desire not to make the removal of the article 20 from the package 10 unnecessarily burdensome to a purchaser or other legitimate owner of the packaged article 20, at least the front panel 11 is made sufficiently thin to be able to cut through it with a utility knife or the like. Thus, the problem to be dealt with by the present invention was to make the "slash-and-steal" approach unappealing to a putative shoplifter by increasing the danger of being caught in the act while not increasing the burden on the legitimate owner to any significant extent.

This was accomplished in accordance with the present invention by the incorporation of a holding element 30 within the package 10. As is most clearly revealed in FIG. 2 of the drawing, the holding element 30 includes two end regions 31 and 32 that are, for all intents and purposes, aligned with one another, and a central region 33 that is rigidly connected with the end regions 31 and 32 but is "raised" with respect thereto, thus bounding a receiving recess 34.

It may be seen particularly by observing FIGS. 1 and 3 of the drawing in conjunction with one another that the holding element 30, like the article 20 itself, is also substantially snugly received in the compartment 14 in that the contoured region of the front panel 11 is shaped appropriately to accomplish this purpose. When the holding element 30 is received in the compartment 14, its end portions 31 and 32 are situated adjacent the backing panel 16, whereas the "raised" central portion 33 is disposed at a distance (raised) from the backing panel 16 so that it embraces a portion of the article 20, such portion being thus received in the aforementioned recess 34.

The holding element 30 is advantageously made, in accordance with the present invention, of a material that is much sturdier than that of the front panel 11. In any event, the holding element 30 is strong enough, be it because of the material it is made of, or because of its increased thickness, or both, to make it virtually impossible to cut through it with a utility knife or a similar tool. Thus, if a perpetrator were to make a single slash through the front panel, any attempt to remove the article 20 through the thus created slit would invariably falter, regardless of the direction of the cut.

If the cut were made in a diagonal direction parallel to the longitudinal direction of the article 20 (as such cuts were typically made in the past), then the holding element 30 would still remain securely lodged in the compartment 14 and thus prevent extraction of the article 20 through the aforementioned slit. If an observant and resourceful perpetrator noticed the presence of the holding element 30 and made the single cut along the longitudinal direction of the holding element 30, he or she would be able to remove the holding element 30 through the resultant slit, but not the article 20 itself because the latter, because of its snug accommodation in the compartment 14, could not be maneuvered into a position in which it could be removed from the package 10 through such slit, at least not easily.

Now, in the retail store environment, the perpetrator usually does not have the luxury of time at his or her disposal; thus, one quick cut and subsequent rapid article extraction motion is about all that a perpetrator would dare to do since anything more (another cut, and/or more complicated extraction maneuver) would put the perpetrator at an unacceptable risk of being caught redhanded, so to speak. Thus, the presence of the holding element 30 within the package 10, if noticed by the perpetrator to begin with, will act as a deterrent from even slashing the front panel 11 of the package 10 in the first place.

On the other hand, if the perpetrator does not initially realize that such element 30 is present in the package 10, he or she will certainly notice it after making the initial diagonal cut and attempting to no avail to remove the article 20 from the package 10 through the thus formed slit, and abandon all further efforts at extraction for fear of being noticed. This latter scenario is most likely to be followed when the holding element 30 is of a transparent material, especially that of a synthetic plastic material variety that is commercially available under a trademark such as Plexiglas or Lucite, or the raw materials for forming the same are thus available.

In any event, once the potential thief realizes the presence of the holding element 30 over a portion of the article 20 contained in the blister package 10, it is highly unlikely if not out of question that he or she would continue his or her efforts to remove the article 20 from the package 10 by making an additional, crosswise, cut or by trying to manipulate the article 20 and/or the holding element 30 to get them both out one after the other through the very same original slit.

On the other hand, the holding element 30 does not unduly complicate the removal of the article 20 from the package 10 for the rightful owner. This is so because, once the owner has discovered or learned about the way of removing the article 20 from the package 10, which means destroying or disintegrating the package 10 or at least the front panel 11 thereof in one way or another, and has obtained the tool or tools for accomplishing this purpose, it is easy for him or her to follow the same course of action seriatim for the removal of both the holding element 30 and the article 20. So, for instance, if the course of action adopted by the user is cutting through the front panel 11 of the package 10, it requires almost no additional effort to make two criss-crossing slits instead of one, and then to lift the thus obtained four segments as required to remove first the holding element 30 and then the article 20. Typically, however, the user cuts along the rib 12 to remove the article 20.

As shown in FIGS. 4 and 5 for the sake of completeness, the rear panel 15 is provided with a plurality of upstanding reinforcing ribs 17 that extend transversely of the package 10, that is, horizontally as considered in the orientation the package 10 assumes in FIG. 5 that usually corresponds to that in which the package 10 is being displayed. The presence of the reinforcing ribs 17 not only makes the package more sturdy and thus less prone to be mangled or otherwise damaged in the course of normal manipulation, but also, and possibly more importantly, renders it difficult almost to the point of utter impossibility to cause the holder element 30 and the article 20 to pop out of the package 10 through the same surreptitiously made single slit by bending the package 10 to the extent necessary for the slit to widen sufficiently for such popping out to occur.

It will be understood that each of the elements described above, or two or more together, may also find a useful application in other types of constructions differing from the type described above.

While the present invention has been described and illustrated herein as embodied in a specific construction of a blister-type article display package for a pocket knife, it is not limited to the details of this particular construction, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

We claim:

1. An improved, point-of-sale, tamper-resistant package for displaying an article to be protected from tampering, the package including a front panel constituted of a cuttable, transparent material having a peripheral portion, and a rear panel secured to the peripheral portion of the front panel, said panels containing the article therebetween, the improved package comprising:

a central region on the front panel interiorly of the peripheral portion, said central region having article-confining wall portions in close, adjacent confronting relationship with top and side surfaces of the article to hold the article in position;

a holding element between the panels and having element portions extending in close, adjacent confronting relationship across the top and side surfaces of the article;

said central region also having element-confining wall portions in close, adjacent confronting relationship with the holding element to hold the holding element in position; and said holding element overlying the article underneath the central region and being constituted of a material more resistant to cutting than said front panel to resist cutting through the holding element to reach the article and to block removal of the article from the package.

2. The improved package as defined in claim 1, wherein the holding element is constituted of a substantially rigid, transparent material.

3. The improved package as defined in claim 1, wherein the holding element has two generally planar end portions that are aligned with one another in a common plane, and an intermediate portion rigidly connected with the end portions and bounding a recess in which the article is received.

4. The improved package as defined in claim 3, wherein the intermediate portion has a generally planar top portion overlying the top of the article and lying in an elevated plane generally parallel to said common plane, and a pair of side portions extending between the top portion and the end portions in a direction generally perpendicular to said planes.

5. The improved package as defined in claim 3, wherein said end portions of the holding element extend toward, but terminate short of, the peripheral portion of the front panel.

* * * * *